US006974091B2

(12) United States Patent
McLisky

(10) Patent No.: US 6,974,091 B2
(45) Date of Patent: Dec. 13, 2005

(54) DISPENSING MEANS

(76) Inventor: Nigel Haig McLisky, 94 Ladies Mile, Remuera, Auckland (NZ), 1005

( * ) Notice: Subject to any disclaimer, the term of this patent is extended or adjusted under 35 U.S.C. 154(b) by 202 days.

(21) Appl. No.: 10/416,491

(22) PCT Filed: Nov. 19, 2001

(86) PCT No.: PCT/NZ01/00259

§ 371 (c)(1),
(2), (4) Date: May 16, 2003

(87) PCT Pub. No.: WO02/40376

PCT Pub. Date: May 23, 2002

(65) Prior Publication Data

US 2004/0124264 A1 Jul. 1, 2004

(30) Foreign Application Priority Data

Nov. 17, 2000 (NZ) ..... 508209
Jun. 12, 2001 (NZ) ..... 512322

(51) Int. Cl.[7] ..... A62C 13/62; A62C 13/66; B05B 1/00; B05B 1/30

(52) U.S. Cl. ..... 239/302; 239/600; 239/569; 239/585.1; 239/332; 239/333

(58) Field of Search ..... 239/302, 600, 239/569, 585.1, 332, 333, 345, 349

(56) References Cited

U.S. PATENT DOCUMENTS 4,527,635 A * 7/1985 Kirchner ..... 169/26
5,029,758 A * 7/1991 Chayer ..... 239/172
5,397,028 A 3/1995 Jesadanont
5,397,034 A 3/1995 Wunsch
5,820,472 A * 10/1998 Briggs ..... 472/128
6,065,547 A * 5/2000 Ellis et al. ..... 169/89
6,068,058 A * 5/2000 Ellis et al. ..... 169/74
6,170,706 B1 * 1/2001 Havlovitz ..... 222/109

FOREIGN PATENT DOCUMENTS

| | | |
|---|---|---|
| EP | 038598 A | 10/1981 |
| JP | 10175685 | 6/1998 |
| WO | WO 90/05580 | 5/1990 |

* cited by examiner

*Primary Examiner*—Davis Hwu

(57) ABSTRACT

The invention relates to portable dispensing means having a spray head (1) and a spray material storage canister (2), the spray head (1) and the canister being attachable to one another and also being subsequently detachable from one another, the dispensing means being formed such that when it is in use it can be sert so that spray material within the canister can move into the spray head and pass from the spray head to an atmosphere outside of the dispensing means in the form of a spray, the dispensing means being formed such that when it is in a normal in-use orientation and is activated the spray can proceed from the spray head in a substantially vertical or upward path of travel.

17 Claims, 3 Drawing Sheets

DISPENSING MEANS

TECHNICAL FIELD

This invention relates to dispensing means. In particular, a preferred form of the invention relates to dispensing means for use in the context of releasing a spray into the air.

BACKGROUND ART

It is known to periodically release a spray of insecticide, perfume, or the like, into a defined area to overcome the presence of unwanted insects or unpleasant odors. This process is often done manually with the use of an aerosol spray dispenser, and can prove inconvenient as one must remember to periodically cause a spray to be released. Additionally, a further inconvenience is that the manual nature of the process makes it difficult to release a consistent dose in terms of the quantity of the spray. It is accordingly an object of at least one embodiment of the present invention to go at least some way towards addressing the above inconveniences, or to at least provide the public with a useful choice.

In this document the term "comprise", "comprises", or "comprising", if and when used, should be interpreted to be non-exclusive, ie should be interpreted to convey "consisting of or including".

DISCLOSURE OF INVENTION

According to one aspect of the invention there is provided portable dispensing means having a spray emitting portion and a spray material storage portion, the spray emitting portion and the spray material storage portion being attachable to one another and also being subsequently detachable from one another, the dispensing means being formed such that when it is in use it can be set so that spray material within the spray material storage portion can move into the spray emitting portion and pass from the spray emitting portion to an atmosphere outside of the dispensing means in the form of a spray, the dispensing means being formed such that when it is in a normal in-use orientation and is activated the spray can proceed from the spray emitting portion in a substantially vertical or upward path of travel.

Preferably the dispensing means can be set into operation such that it will automatically cease operation after a predetermined period of time.

Preferably the spray emitting portion has valve means which can open to allow a flow of the spray material into the spray emitting portion; and can subsequently close to prevent such flow of the spray material.

Preferably the valve means comprises a solenoid valve.

Preferably the spray emitting portion comprises electronic means which regulates opening and closing of the valve means when the dispensing means is in use. The electronic means may be formed to regulate the quantity of spray material released from the spray emitting portion as a spray, and/or the time during and/or between which the spray material is released as a spray.

Optionally the dispensing means has a battery for energising the electronic means and for giving power to enable the valve means to open and close.

Optionally the dispensing means is adapted to receive an external supply of power for energising the electronic means and to enable the valve means to open and close.

The arrangement may be such that the dispensing means can receive an external source of DC electricity, optionally via a suitable transformer if that is appropriate.

Optionally the dispensing means can be set to also cause a spray of the spray material to proceed from the spray emitting portion in a substantially horizontal path of travel when the dispensing means is operated in a normal in-use orientation.

Optionally the spray emitting portion has a detachable nozzle adapted to direct the spray material to spray in the substantially vertical or upward path of travel.

Optionally the spray emitting portion has a second detachable nozzle adapted to direct the spray material to spray in the substantially horizontal path of travel.

Optionally the first and second detachable nozzles can be fitted to the rest of the spray emitting portion interchangeably.

Preferably the dispensing means has securement means to enable it to be easily releasably attached to a building construction. The securement means may be adapted to enable the dispensing means to hang from a wall and/or from a pipe.

Optionally the spray material comprises an insecticide (eg for killing or repelling insects), a perfume, an odor neutraliser, a medicine, a gas, an essential oil, or any suitable combination of these.

In a further aspect of the invention there is provided a method of dispensing a spray into an atmosphere, including the steps of:

i) obtaining dispensing means as described above and engaging it with a building construction such that it is in an elevated position, and ii) setting the dispensing means into operation to automatically deliver controlled periodic doses of spray into the atmosphere.

Optionally the building construction is used for milking cows.

DESCRIPTION OF DRAWINGS

Some preferred aspects and embodiments of the invention will now be described by way of example, and/or with reference to the accompanying drawings, of which.

DETAILED DESCRIPTION

Figure 1:
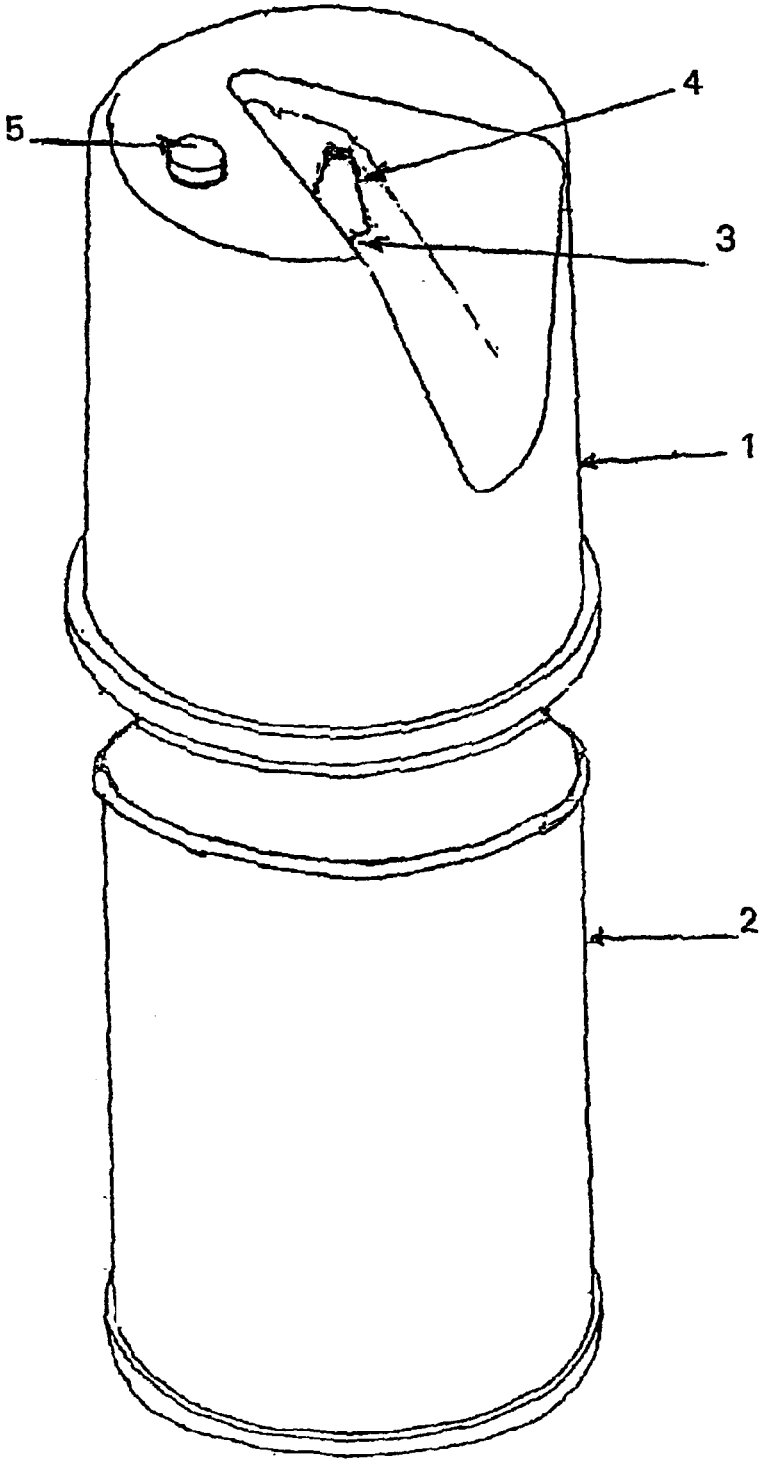
FIG. 1 is a three dimensional view of a portable spray dispenser.

Referring to FIG. 1, the spray dispenser comprises a spray emitting portion in the form of a spray head 1 detachably fitted to a spray material storage portion in the form of a canister 2 of spray material. The spray material may be an insecticide (eg for killing or repelling insects), a perfume, an odor neutraliser, a medicine, an essential oil, a visible or invisible gas, or any suitable combination of these. The spray material may be any suitable substance capable of becoming a spray. The spray head 1 and the canister 2 are such that they can be screwed together, or detachably combined by some other suitable means. The spray head 1 has an aperture 3 through which protrudes a spray nozzle 4. The spray head 1 also has a switch 5 which can be activated to set the spray dispenser into operation.

When the spray dispenser is set into operation it releases into the external atmosphere periodic metered doses of a spray of the spray material. The spray may be in the form of a mist, etc, and may or may not be aerosol in nature. The spray proceeds from the nozzle 4 in an initial substantially vertical path of travel when the spray dispenser is in a normal in-use orientation—ie an upright orientation as shown in FIG. 1. Desirably the spray can drift and disperse through the atmosphere.

Figure 2:
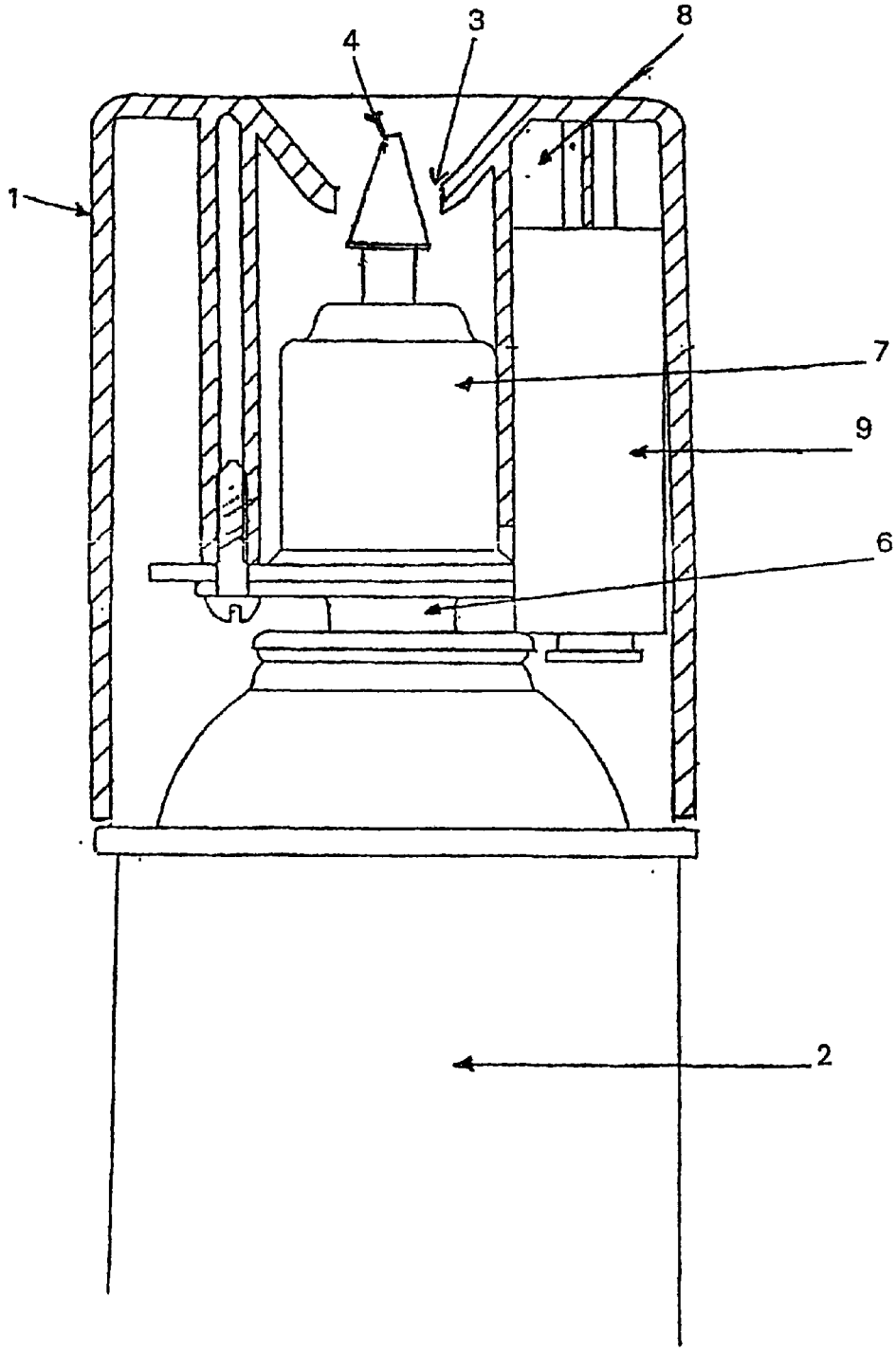
FIG. 2 shows some of the internal components of the spray dispenser of FIG. 1.

Referring to FIG. 2, the spray dispenser has a connecting portion 6 which enables the spray material within the canister 2 to pass into the spray head 1 when desired. The movement of the spray material from the canister 2 to the spray head 1 is at least partially controlled by a solenoid valve 7, which can open to allow a flow of the spray material, and subsequently close to prevent such a flow. The solenoid valve is itself regulated by way of electronic means in the form of a circuit board 8 which determines when the valve will open and close, how long it will remain open for, and thus the quantity of spray material released from the nozzle 4 as a spray. A battery 9 adjacent the valve 7 and the circuit board 8 provides power to energise the circuit board and to enable opening and closing of the valve.

When the spray material within the canister 2 is exhausted the canister can be detached from the spray head 1 and replaced with a new canister. Additionally, the spray head 1 is preferably capable of engaging a range of different sized canisters in term of their capacity to hold spray material. Preferably when the spray dispenser is set in use the circuit board 8 works to limit the period which the spray dispenser is operational—for example once activated the spray dispenser may remain operational for a set time such as 15 minutes, two hours, etc, and then automatically turn itself off. This ensures that the spray material is not wasted through operation of the spray dispenser when it is not needed, or if an operator forgets to turn it off. The spray dispenser may also be turned off manually by way of the switch 5. Preferably the spray dispenser is programmable so that the length of time that it operates and the amount of spray dispensed can be set as desired.

Figure 3:
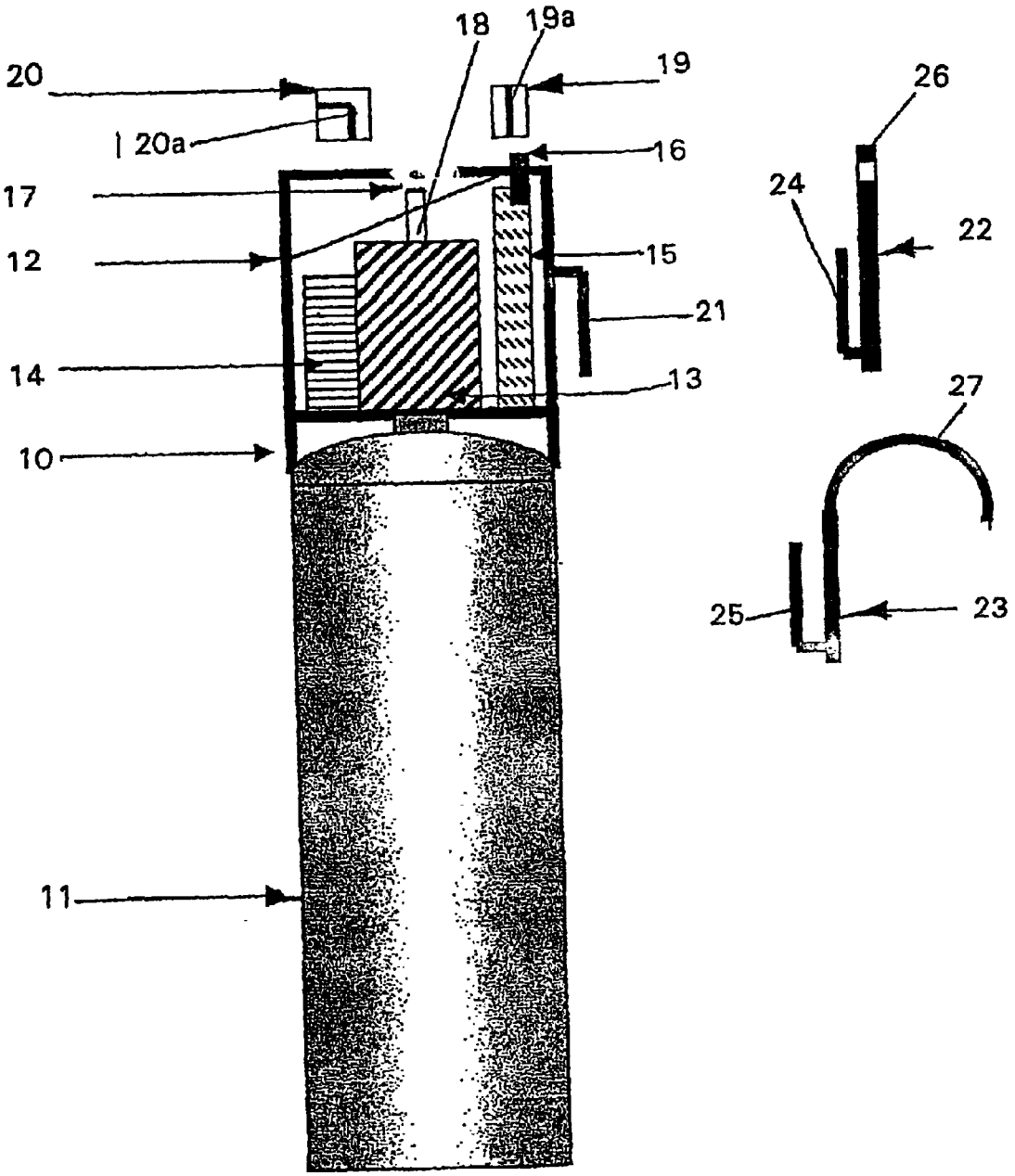
FIG. 3 is a schematic view showing a portable spray dispenser according to another embodiment of the invention.

Turning to FIG. 3, an alternative spray dispenser 10 has a canister 11 of spray material and a spray head 12 detachably fitted to one another similar to the arrangement described with reference to FIGS. 1 and 2. Moreover, the spray head 12 has a solenoid valve 13, a battery 14, and a circuit board 15 arranged to function together to control the flow of spray material from the canister 11 into the spray head 12, and then out of the spray head 12 as a spray. As shown, the spray head 12 also has a switch 16 which can be activated to set the alternative spray dispenser into operation.

Referring to FIG. 3, the spray head 12 has an aperture 17 for receiving a spray nozzle which releases the spray material as a spray. The nozzle comprises an upright stem 18 proceeding from the valve 13 together with a cap member 19 or 20. The cap members 19 and 20 can be used alternatively, and when in use fit onto the stem 18 respectively. The cap member 19 has an internal passage 19*a* adapted to direct the spray from the spray head 10 in a substantially vertical path of travel when the alternative dispenser is in a normal in-use orientation (ie as shown in FIG. 3). Similarly, the cap member 20 has an internal passage 20*a* adapted to direct the spray from the spray head 10 in a substantially horizontal path of travel when the alternative dispenser is in the normal in-use orientation. The alternative spray dispenser 10 can thus be used to emit a vertical or a horizontal spray as desired. In some alternative embodiments of the invention the arrangement may be such that vertical and horizontal sprays can be emitted simultaneously. The use of a vertical spray minimises the risk of people being inadvertently sprayed, and is particularly applicable when the invention is used at ground or floor level. When the invention is used in an elevated situation, for example hanging from a wall or a pipe, it may be more applicable to use the horizontal spray option described above.

With further reference to FIG. 3, the alternative spray dispenser has a downwardly projecting hook 21 adapted to engage a wall bracket 22 or a pipe bracket 23. In each case the projecting hook 21 is adapted to hook onto upwardly facing hooks 24 and 25 of the wall bracket or pipe bracket respectively. As shown, the wall bracket 22 has a plate portion 26 which can be screwed into a wall or the like, and the pipe bracket 23 has a pipe engaging hook 27 adapted to hook on over the top part of a pipe.

As will be appreciated, the invention has particular use in controlling the presence of insects in or around a milking shed. Insects such as flys can disturb a cow while being milked, with the effect that the quantity or quality of milk is reduced, thus adversely effecting the profitability of the milking process. Flys, etc, may also cause cows to become unsettled while being milked, and this can lead to milking gear being displaced, thus resulting in additional work on the part of a farmer. The invention may be used to disperse a spray within a milking shed or outside of the shed. The invention is of-course not limited to only milking applications, and may for example be used domestically on a patio or deck area.

It should be appreciated that while the invention has been described herein by way of example, modifications and improvements can occur without departing from the scope of the appended claims.

What is claimed is:

1. Portable dispensing means having a spray emitting portion and a spray material storage portion, the spray emitting portion and the spray material storage portion being attachable to one another and also being subsequently detachable from one another, the dispensing means being formed such that when it is in use it can be set that spray material within the spray material storage portion can move into the spray emitting portion and pass from the spray emitting portion to an atmosphere outside of the dispensing means in the form of a spray, the dispensing means being formed such that when it is in a normal in-use upright orientation and is activated the spray can proceed from the spray emitting portion in a substantially vertical path of travel, a wherein the dispensing means can be subsequently set to cause a spray of the spray material to proceed from the spray emitting portion in a substantially horizontal path of travel when the dispensing means is in the normal in-use upright orientation.

2. Dispensing means according to claim 1, which can be set into operation such that it can be set to automatically cease operation after a predetermined period of time.

3. Dispensing means according to claim 1, wherein the spray emitting portion has valve means which can open to allow a flow of spray material into the spray emitting portion, and can subsequently close to prevent such flow of the spray material.

4. Dispensing means according to claim 1, wherein the spray emitting portion has valve means which can open to allow a flow of spray material into the spray emitting portion, and can subsequently close to prevent such flow of the spray material, and wherein the valve means comprises a solenoid valve.

5. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use.

6. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, and wherein the electronic means is adapted to regulate at least one of (i) the quantity of spray material released from the spray emitting portion as a spray, and (ii) the time between which the spray material is released as a spray.

7. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, and wherein the dispensing means has a battery for energising the electronic means and for giving power to enable the valve means to open and close.

8. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, the dispensing means adapted to receive an external supply of power for energising the electronic means and to enable the valve means to open and close.

9. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, and wherein the spray emitting portion has a detachable nozzle adapted to direct the spray material to spray in the substantially vertical or upward path of travel.

10. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, and wherein the spray emitting portion has a detachable nozzle adapted to direct the spray material in the substantially horizontal path of travel.

11. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, and wherein the spray emitting portion has a detachable nozzle adapted to direct the spray material in the substantially horizontal path of travel and a detachable nozzle adapted to direct the spray material in the substantially vertical or upward path of travel, and wherein the first and second mentioned detachable nozzles can be fitted to the rest of the spray emitting portion interchangeably.

12. Dispensing means according to claim 1, wherein the dispensing means has securement means to enable the dispensing means to be releasably attached to a building construction.

13. Dispensing means according to claim 1, wherein the dispensing means has securement means to enable the dispensing means to be releasably attached to a building construction, and wherein the securement means is adapted to enable the dispensing means to hang from at least one of a wall and a pipe.

14. Dispensing means according to claim 1, wherein the spray emitting portion has valve means which can open to allow a flow of spray material into the spray emitting portion, and can subsequently close to prevent such flow of the spray material, and wherein the spray emitting portion comprises electronic means which regulates opening and closing of the valve means when the dispensing means is in use, and wherein the spray material comprises at least one of an insecticide, a perfume, an odour neutraliser, a medicine, an essential oil, and any suitable combination of these.

15. A method of dispensing a spray into an atmosphere, including the steps of:

(i) obtaining portable dispensing means, having a spray emitting portion and a spray material storage portion, the spray emitting portion and the spray material storage portion being attachable to one another and also being subsequently detachable from one another, the dispensing means being formed such that when it is in use it can be set so that spray material within the spray material storage portion can move into the spray emitting portion and pass from the spray emitting portion to an atmosphere outside of the dispensing means in the form of a spray, the dispensing means being formed such that when it is in a normal in-use upright orientation and is activated the spray can proceed from the spray emitting portion in a substantially vertical path of travel, and wherein the dispensing means can be subsequently set to cause a spray of the spray material to proceed from the spray emitting portion in a substantially horizontal path of travel when the dispensing means is in the normal in-use upright orientation, and (ii) engaging it with a building construction such that it is in an elevated position, and (iii) setting the dispensing means into operation to automatically deliver controlled periodic doses of spray into the atmosphere.

16. A method according to claim 15, wherein the building construction is used for milking cows.

17. Portable dispensing means having a spray emitting portion and a spray material storage portion, the spray emitting portion and the spray material storage portion being attachable to one another and also being subsequently detachable from one another;

the dispensing means being formed such that when it is in use it can be set so that spray material within the spray material storage portion can move into the spray emitting portion and pass from the spray emitting portion to an atmosphere outside of the dispensing means in the form of a spray.

the spray emitting portion having valve means which can open to allow a flow of spray material into the spray emitting portion, and can subsequently close to prevent such flow of the spray material, and wherein the spray emitting portion comprises electronic means which regulates opening and closing of the valve means when the dispensing means is in use;

the electronic means adapted to regulate at least one of (i) a quantity of spray material released from the spray emitting portion as a spray, and (ii) a time between which the spray material is released as a spray;

the dispensing means being formed such that when it is in a normal in-use upright orientation and is activated the spray can proceed from the spray emitting portion in a substantially vertical path of travel, and wherein the dispensing means can be subsequently set to cause a spray of the spray material to proceed from the spray emitting portion in a substantially horizontal path of travel when the dispensing means is in the normal in-use upright orientation.

* * * * *